United States Patent [19]

Seidel

[11] Patent Number: 5,022,927

[45] Date of Patent: Jun. 11, 1991

[54] METHOD FOR HYDRAULIC CEILING-CONCRETE REMOVAL

[75] Inventor: Jurgen F. Seidel, Calumet City, Ill.

[73] Assignee: Midwest Hydro-Blasting, Inc., Chicago, Ill.

[21] Appl. No.: 449,989

[22] Filed: Dec. 13, 1989

Related U.S. Application Data

[62] Division of Ser. No. 163,273, Mar. 2, 1988, Pat. No. 4,911,188.

[51] Int. Cl.[5] ..... B08B 3/00

[52] U.S. Cl. ..... 134/34; 134/16; 134/36

[58] Field of Search ..... 134/16, 34, 36

[56] References Cited

U.S. PATENT DOCUMENTS

| | | | |
|---|---|---|---|
| 3,027,095 | 3/1962 | Paasche | 239/187 |
| 3,269,659 | 8/1966 | Shelton et al. | 239/187 |
| 3,274,860 | 9/1966 | Gauthier et al. | 74/829 |
| 3,276,695 | 10/1966 | Giardino et al. | 239/142 |
| 3,736,909 | 6/1973 | Marangoni et al. | 122/390 |
| 3,817,262 | 6/1974 | Caradeur et al. | 134/167 |
| 3,957,203 | 5/1976 | Bullard | 239/128 |
| 4,676,189 | 6/1987 | Takeuchi et al. | 118/626 |

OTHER PUBLICATIONS

Brochure of Atlas Copco entitled "Equipment Hydro-Demolition CONJET", and apparently published in Sweden in Feb., 1986.

Single page brochure entitled "Attachment for CONJET-Under-UP FEED" (98511552 01) bearing legend Printed in Sweden 87/08.

Single page Atlas Copco brochure entitled "Attachment for CONJET-SURVEY" (985 1591 01) bearing legend Printed in Sweden 87/08.

Single page Atlas Copco brochure entitled "Attachment for CONJET-VERTICAL FEED" (9851 151801) bearing legend Printed in Sweden 87/08.

Single page Atlas Copco brochure entitled "Attachment for CONJET-SCARIFYING FEED" (9851 1519 01) bearing legend Printed in Sweden 87/08.

Single page Atlas Copco brochure entitled "Attachment for CONJET-ROTOR CLEANER" (19851 1551 01) bearing legend Printed in Sweden 87/08.

*Primary Examiner*—Curtis R. Davis

*Attorney, Agent, or Firm*—Welsh & Katz, Ltd.

[57] ABSTRACT

An apparatus and method for removing concrete from a ceiling surface by hydrodemolition which includes a mobile truck unit adapted for movement along a floor surface or the like and which supports a pair of upstanding telescoping support arms having an elongated boom mounted at their upper ends in a manner to enable selective orientation of the boom relative to a ceiling surface. A carriage is mounted for reciprocating movement along the boom and carries and upwardly directed lance and discharge nozzle operative to discharge high pressure fluid, such as water, against a ceiling surface such that selective movement of the nozzle and mobile truck during high pressure fluid discharge are operative to remove concrete from the ceiling surface.

9 Claims, 3 Drawing Sheets

59
58
66a
12
57
69a
44a
43a
23a
45a
68a
76
42a
43b
44b
56a
55
79
75
72
36a
39a
40a
74
73
71
70
77
36b
42b
23b
45b
46
56b
39b
40b
32a
17
34a
33
32b
18
35a
13
52a
51a
50a
48a
28a
27a
26a
34b
35b
15
30a
29a
14
16
30b
49a
38a
28b
27b
20a
26b
29b
24a
25
20b
38b
24b
48a
50b
21
53
49b
51b

METHOD FOR HYDRAULIC CEILING-CONCRETE REMOVAL

This is a division of application Ser. No. 07/163,273, filed Mar. 2, 1988, now U.S. Pat. No. 4,911,188.

BACKGROUND OF THE INVENTION

Cement structures, particularly those using reinforced concrete, suffer degradation over time and with use. Cracks often develop and even portions of the cement may dislodge The problem becomes particularly acute in regions which include salt as an environmental ingredient. This occurs, of course in localities near the ocean which receive salt directly from the water spray and the like. Furthermore, the salting of roads in the northern portions of this country during winter have an especial destructive effect upon cement structures.

The repair of cement damaged by the environment and use generally commences with the removal of the remaining surface layers of concrete. This cleans out degraded or dislodged cement, much like drilling a decayed tooth. Replacing the removed cement with new concrete precludes the further and dangerous degradation of the cement structure.

The removal of cement has often entailed the use of jack hammers generally operating under pneumatic pressure. This type of equipment has proven very slow, requires a large number of employee hours, and thus entails a very substantial expense to a structure's owner. It can also create microcracks in the structure.

A more recent type of device employs a strong stream of water, under high pressure, to remove the superficial cement. Typically, a nozzle moves across a boom positioned over a cement floor, roadway, or the like. The boom, in turn, connects to a tractor which moves in the direction generally perpendicular to that in which the nozzle travels. The coordinated motions of the nozzle on the boom moving in a first direction and the tractor holding the boom in a perpendicular direction permits the coverage of a large area of cement floor or roadway with a minimal number of employees. It also produces a smoother surface which admits to a more uniform layer of new cement and thus a stronger resulting structure. The Atlas-Copco Company in Sweden has produced equipment of this type.

However, the hydraulic demolition equipment utilizing a nozzle traveling on a boom attached to a tractor has a limited utility. It only operates upon the upward-facing surface upon which the tractor may sit. This limits its use to cement floors, roadways, aprons, and the like.

However, many cement structures have downwardly facing surfaces as well. This occurs, of course, in buildings. The ceiling surface may also undergo degradation, especially in structures such as parking lots or other areas which suffer heavy wear from vehicles. Accordingly, a need exists for equipment to effectuate the surface demolition of cement on ceiling surfaces and the like.

SUMMARY OF THE INVENTION

One of the primary objects of the present invention is to provide a novel method and apparatus for hydraulically removing concrete from a ceiling surface.

A more particular object of the present invention is to provide a novel method and apparatus for hydraulically removing concrete from a ceiling surface wherein the apparatus employs a mobile support truck adapted for movement along a floor surface or the like. The truck carries telescoping support arm means in the form of a pair of telescoping upstanding support arms which support a transverse boom so as to enable selective orientation of the boom relative to a ceiling surface. A carriage is reciprocally movable along the boom and carries a lance having a high pressure fluid discharge nozzle operative to discharge high-pressure fluid, such as water, against the ceiling surface as the nozzle and truck undergo predetermined movement relative to the ceiling surface.

A feature of the ceiling concrete removing method and apparatus in accordance with the present invention lies in the provision of control means at opposite ends of the boom which are operative in response to traverse of the carriage to effect automatic reversal and reciprocating movement of the carriage and facilitate a optimum pattern of nozzle movement for concrete removal.

Further objects, advantages and features of the invention, together with the organization and manner of operation thereof, will become apparent from the following detailed description of the invention when taken in conjunction with the accompanying drawings wherein like reference numerals designate like elements throughout the several views.

DETAILED DESCRIPTION

Figure 1:
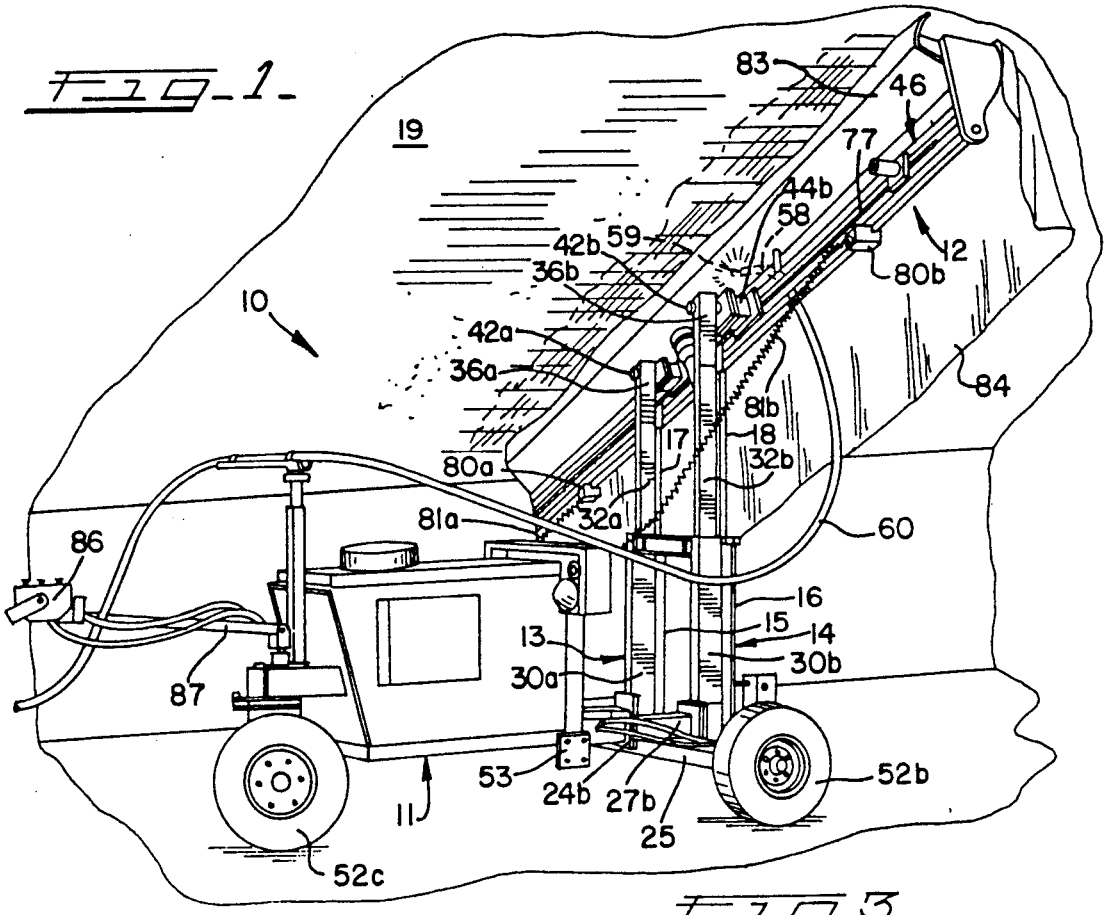
FIG. 1 is a perspective view of an apparatus for removing concrete from a ceiling surface utilizing water under pressure in accordance with the present invention.

Referring to the drawings, apparatus for removing concrete from a ceiling surface, alternatively termed a hydraulic ceiling concrete remover, in accordance with the method of the present invention is indicated generally at 10 in FIG. 1. The apparatus 10 includes mobile support means in the form of a tractor 11, and elongated boom means in the form of a boom 12. The boom is supported on the upper end of telescoping support arm means in the form of a pair of telescoping upstanding support arm 13 and 14.

Figure 3:
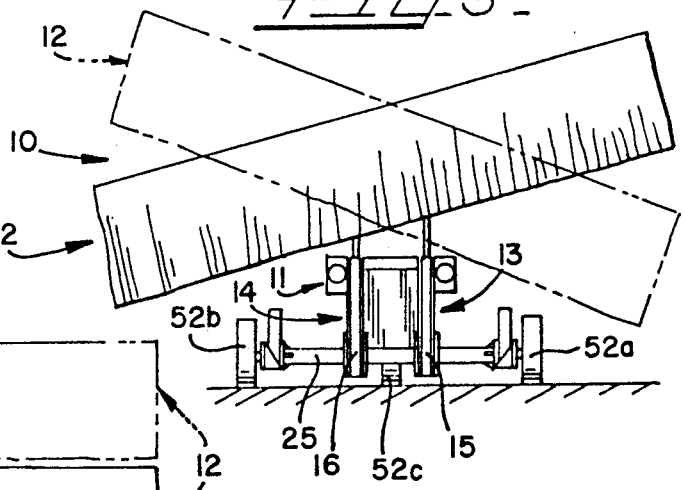
FIG. 3 is a front elevational view of the apparatus of FIG. 2 but with the boom shown tilted in a first angular position in solid lines, and shown in an opposite angular position in phantom.
Figure 2:
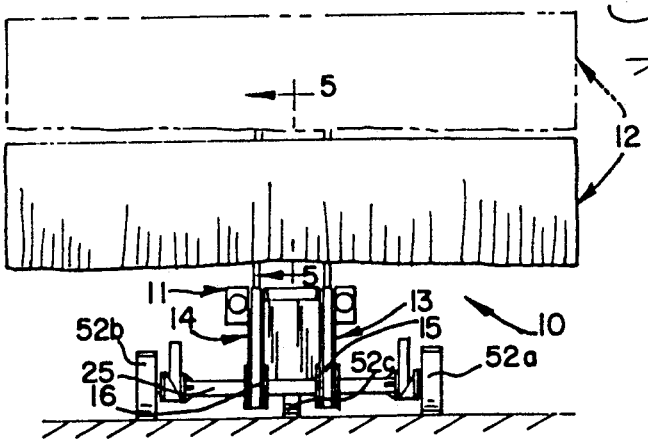
FIG. 2 is a front elevational view of the ceiling concrete removing apparatus of FIG. 1 with the boom shown in a lowered position in solid lines and in an elevated operating position in phantom.
Figure 4:
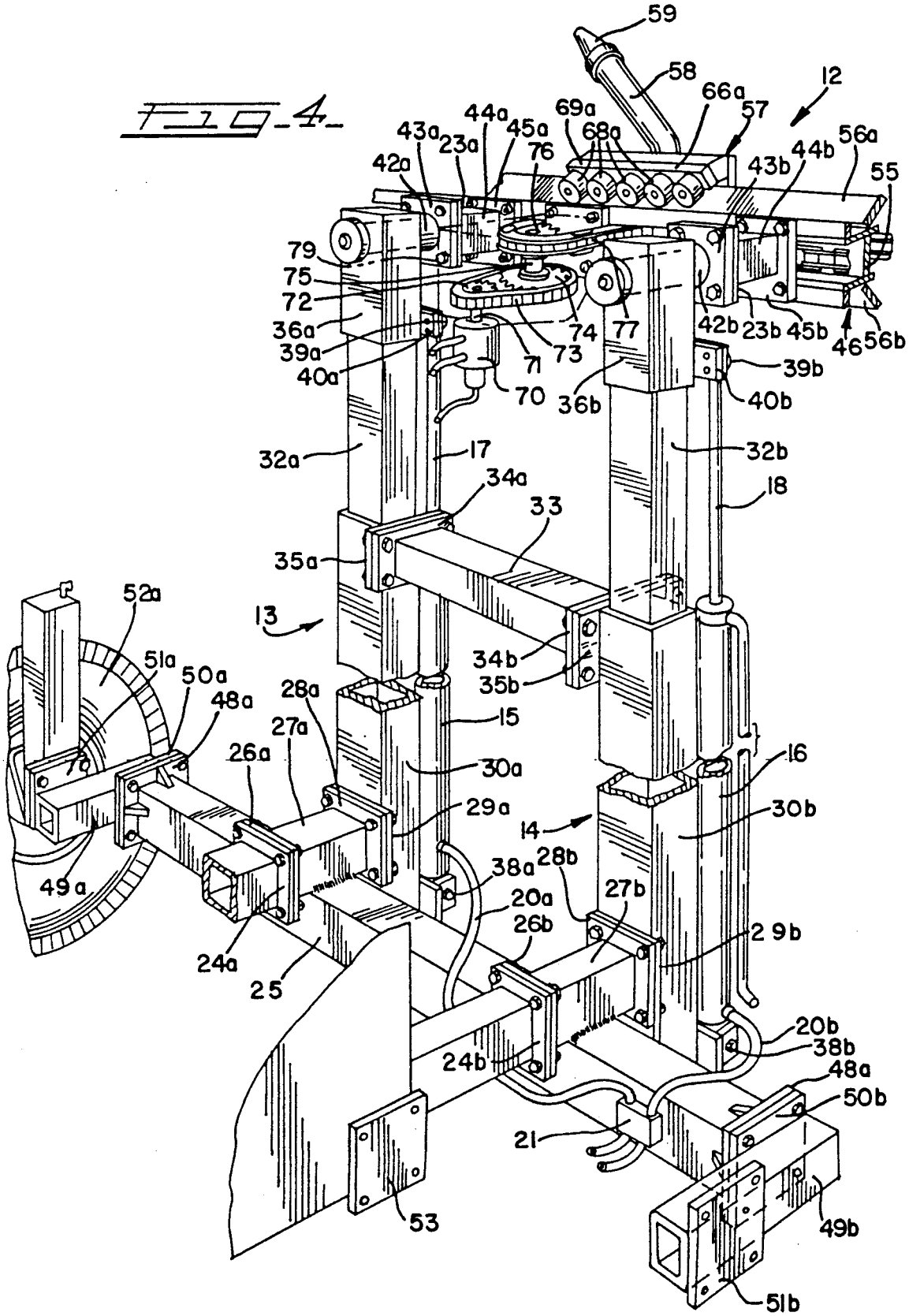
FIG. 4 is a fragmentary perspective view of the concrete removing apparatus of FIG. 1 with portions broken away to illustrate the mechanism for raising and lowering the boom and for effecting traverse of the nozzle and lance carriage along the boom.
Figure 5:
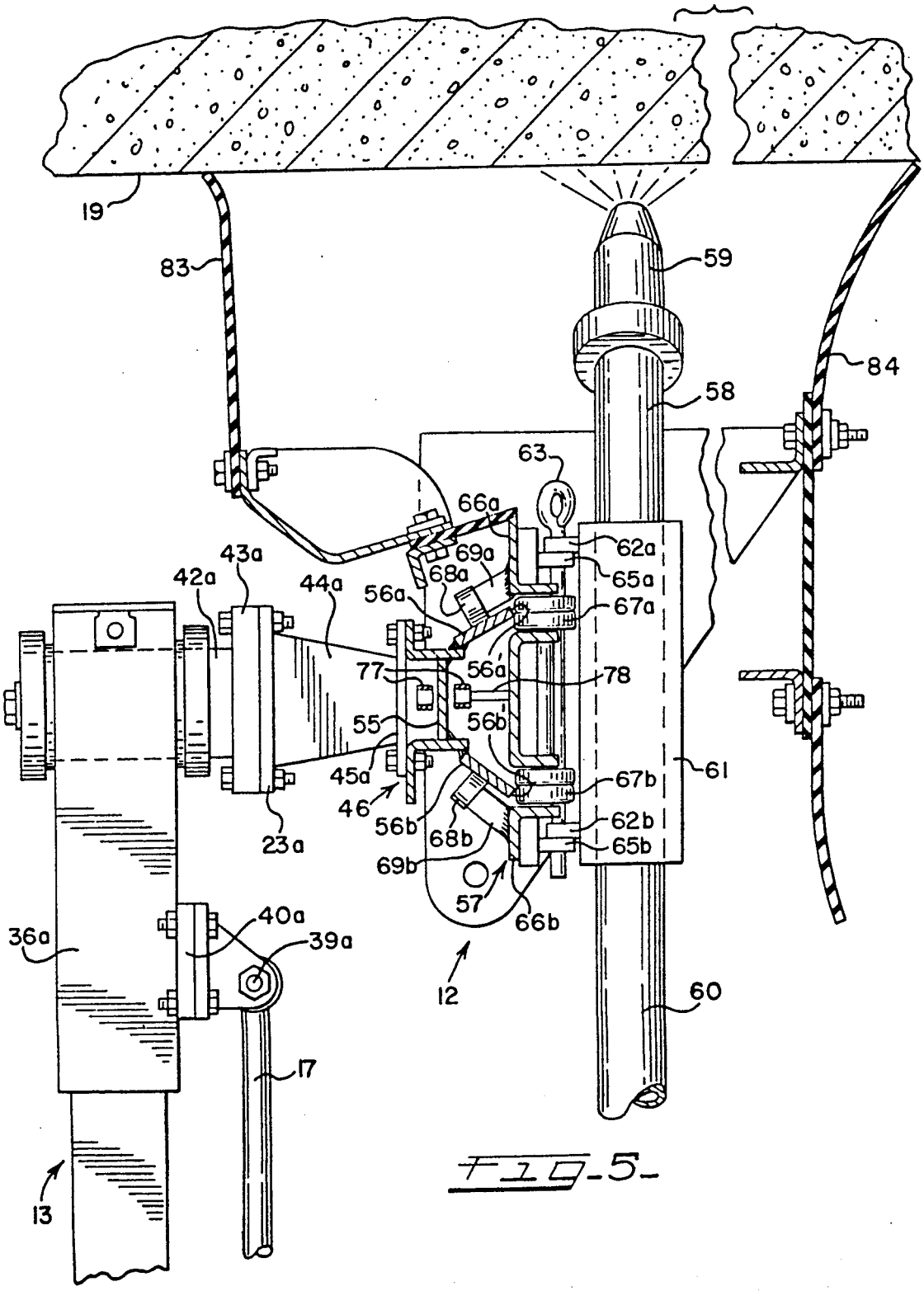
FIG. 5 is an enlarged fragmentary cross-sectional view taken substantially along line 5—5 of FIG. 2.

A pair of hydraulic cylinders 15 and 16 are operatively connected, respectively, to the telescoping arms 13 and 14 and have corresponding extendable piston rods 17 and 18 (FIG. 4) for selective raising and lowering of the boom 12 so as to position it substantially parallel to a ceiling surface, indicated at 19 in FIGS. 1 and 5, for demolition work. The cylinders 15 and 16 comprise actuator means adapted for separate operation so as to enable selective varying of the longitudinal lengths of the support arms 13 and 14 and thereby selective movement of the boom between an elevated operating position, shown in phantom in FIG. 2, and a lowered nonoperating position as shown in solid lines. Since not all concrete ceilings or raised concrete surfaces lie parallel to the underlying floor or support surface on which the tractor 11 may be supported, independent operation of the cylinders 15 and 16 permits the boom 12 to be tilted generally about an axis transverse to the boom as shown in solid and phantom lines in FIG. 3.

As illustrated in FIG. 4, the cylinders 15 and 16 are connected to hydraulic lines or hoses 20*a* and 20*b* which are interconnected through a conventional hydraulic lock 21, such as manufactured by the Monson Tison Mfg. Company of Sweden. The hydraulic lock 21 is operative to prevent inadvertent lowering of the boom in the event of hydraulic pressure failure to the cylinders 15 and 16 thereby assisting in safe operation.

The boom 12 may be disconnected from the support arms 13 and 14 and rotated or swung 180 degrees about its transverse axis, and then connected directly to the tractor 11 to remove concrete from a floor surface, thus eliminating the support arms 13 and 14. For this purpose, a pair of boom connecting plates 23*a* and 23*b* may be connected, respectively, directly to a pair of tractor connecting plates 24*a* and 23*b*. This latter configuration basically constitutes the configuration in which Atlas-Copco Company of Sweden sells its equipment. Since in the removal of concrete from a floor surface the tractor 11 is disposed on the floor undergoing demolition, very little, if any, need exists to adjust the height of the boom relative to the floor surface during demolition.

To convert the boom 12 from a floor demolition condition to a condition for working on a ceiling surface, the boom plates 23*a* and 23*b* are disconnected from the tractor plates 24*a* and 23*b*. A cross bar or support beam 25 is then attached to the tractor plates 24*a* and 24*b* through face plates 26*a* and 26*b* which are fixed to ends of corresponding connecting bars 27*a* and 27*b* welded transversely to the support beam 25. A pair of mounting plates 28*a* and 28*b* are fixed to opposite ends of the connecting bars 27*a* and 27*b* and are adapted for releasable connection to face plates 29*a* and 29*b*, respectively, fixed to outer rectangular sleeves 30*a* and 30*b* of the support arms 13 and 14.

The upstanding support arms 13 and 14 include upper extendable members 32*a* and 32*b* of rectangular transverse cross section which telescope into the corresponding fixed outer sleeves 30*a* and 30*b*. A rigid beam or bar 33 has end plates 34*a* and 34*b* attached to its opposite ends which are secured to the sleeves 30*a* and 30*b* through mounting plates 35*a* and 55*b* so as to provide structural rigidity for the support arms 13 and 14. Rectangular end caps 36*a* and 36*b* are fixed to the upper ends of the extendable members 32*a* and 32*b*, respectively. The hydraulic cylinders 15 and 16 are connected at their lower ends, respectively, to the outer sleeves 30*a* and 30*b* at pivot connections 38*a* and 38*b*, and have the upper ends of their piston rods 17 and 18 suitably pivotally connected at 39*a* and 39*b* to the upper ends of the telescoping members 32*a* and 32*b* through connector brackets 40*a* and 40*b* fixed to the corresponding end caps 36*a,b*.

Pivot shafts 42*a* and 42*b* pass through and are supported by the end caps 36*a* and 36*b*, respectively, so as to enable rotation of the pivot shafts about their longitudinal axes. A pair of mounting plates 43*a* and 43*b* are fixed to the rearward ends of the pivot shafts 42*a* and 42*b* and facilitate attachment of the boom 12 to the support arms 13 and 14 through the boom connecting plates 23*a* and 23*b* which are fixed on ends of corresponding spacer members 44*a* and 44*b*. The spacer members 44*a,b* have mounting plates 45*a* and 45*b* fixed on their opposite ends, the latter being attached to an elongated boom guide track 46 as by bolts or the like. In this manner, the boom 12 may be adjusted to a predetermined work position relative to the ceiling 19 by selective actuation of the cylinders 15 and 16.

To help prevent tipping of the tractor 11, the crossbar or beam 25 has end plates 48*a* and 48*b* fixed thereon to which are attached mounting bars 49*a* and 49*b* through mounting plates 50*a* and 50*b*. The mounting bars 49*a* and 49*b* have outer plates 51*a* and 51*b* which facilitate mounting of wheels 52*a* and 52*b* to the opposite ends of the beam 25. When being employed to remove concrete from a floor surface, the wheels 52*a* and 52*b* may be fixed directly to the tractor chassis, as through mounting plates, one of which is illustrated at 53 in FIGS. 1 and 4. By mounting the wheels 52*a* and 52*b* on the outer ends of the crossbar 25, an outrigger type arrangement is established which provides greater stability for the tractor 11. This is desirable when the boom 12 is elevated to heights, such as 12 feet, frequently necessary for operating upon ceilings of commercial structures. The tractor 11 also has a steerable third wheel 52*c* which may be rotatably driven through a suitable hydraulic motor (not shown) to control movement of the tractor 11, and thus movement of the boom 12, relative to a ceiling surface. A counterbalance weight (not shown) may be mounted on the front end of the tractor opposite the boom so as to counterbalance the boom 12 and provide greater stability for the tractor.

As illustrated in FIGS. 4 and 5, the boom 12 includes the aforementioned elongated guide track 46 which is comprised of an elongated support beam or angle frame 55 connected to the 24 mounting plates 45*a* and 45*b* and which carries a pair of elongated rail plates 56*a* and 56*b* fixed along the length of the angle frame as by welding. The angle frame 55 and rail plates 56*a,b* establish an elongated guide track to support and guide carriage means in the form of a carriage or sled 57 which carries a tubular lance 58 and an associated fluid pressure discharge nozzle 59 for rectilinear reciprocating movement along the boom.

The lance 58 supports the nozzle 59 at its upper outer end and is connected to a fluid pressure hose 60. The nozzle 59 is operative to direct a stream of high pressure water from the hose 60 against the ceiling surface 19. The lance 58 is supported by a sleeve 61 which has a pair of longitudinally spaced mounting tabs or pivot brackets 62*a* and 62*b* fixed to its outer surface. The pivot brackets define axially aligned openings to receive a quick release support pin 63. The support pin 63 also passes through a pair of pivot flanges or tabs 65*a* and 65*b* which are fixed to the carriage or sled 57. Lifting the pin 63 vertically permits removal of the sleeve 61 from the carriage 57 and facilitates servicing or replacement of the sleeve, lance and nozzle.

The carriage or sled 57 includes a pair of parallel angles 66*a* and 66*b* which support upper and lower pairs of bearings 67*a* and 67*b* such that the bearings ride against free edges 56*a* and 56*b* on the rails 56*a* and 56*b*. The angles 66*a* and 66*b* also support upper and lower rows of guide bearings 68*a* and 68*b* through mounting blocks 69*a* and 69*b*, respectively, such that the bearings 68*a,b* ride along upwardly and downwardly facing surfaces of the rails 56*a,b*. The bearings 67*a,b* and 68*a,b* thus cooperate to maintain the carriage or sled 57 mounted on the boom rails 56*a* and 56*b* and enable reciprocating movement of the sled along the length of the boom.

The sled 57 and associated lance 58 and nozzle 59 are caused to selectively traverse the length of the boom 12 by drive means in the form of a reversible hydraulic motor 70 (FIG. 4) having a drive shaft 71 on which is mounted a drive sprocket 72. An endless drive chain 73 interconnects the sprocket wheel 172 to a second driven sprocket 74 fixed to the lower end of an upstanding axle 75 on which an upper sprocket wheel 76 is fixedly mounted. A lance chain 77 is supported by boom angle frame 55 so as to extend the full length of the angle frame and is passed about the sprocket 76 and about a pair of sprockets (not shown) at the opposite ends of the angle frame so that opposite ends of the lance chain are passed back along the side of the angle frame opposite the drive sprocket 76 and are connected to the sled 57 by connecting brackets or tabs, one of which is shown at 78 in FIG. 5. In this manner, selective rotation of driven sprocket 76 through the drive motor 70 effects selective movement of the sled 57 along the length of the boom. The chain and sprocket drive interconnecting the drive motor 70 to the lance chain 77 are preferably enclosed within a suitable housing as illustrated in phantom at 79 in FIG. 4. Control means in the form of a pair of limit switches 80*a* and 80*b* (FIG. 1) are supported generally adjacent opposite ends of the boom 12 and are connected through leads 81*a,b* to a hydraulic control (not shown) for the drive motor 70 so as to automatically reverse the direction of rotation of the drive motor and thereby the direction of traverse of the sled 57 each time the sled engages a limit switch 80*a* or 80*b*.

As the nozzle 59 directs water under pressure upwardly against a ceiling surface, debris and water may spatter downwardly. To confine splatter, a pair of shrouds 83 and 84 are supported along the length of boom so as to provide an enclosure around the nozzle 59 to protect personnel and property in the area. The shrouds 83 and 84 have free upper edges which extend above the height of the nozzle 59 so as to engage the ceiling surface without inhibiting movement of the lance and nozzle.

A more effective and even removal of ceiling concrete occurs if the boom is moved transverse to its longitudinal axis in forward and backward steps to provide a repetitive, back-and-forth motion as the lance and nozzle traverse the boom. One sequence of steps that has proven very effective after positioning the boom generally parallel to and adjacent the ceiling surface involves first moving the lance from one end of the boom to the other end, then moving the tractor 11 so as to move the boom 12 one step in a first direction perpendicular or transverse to the direction of lance travel. The lance and nozzle are then caused to travel back along the boom from the second to the first end by the actuated limit switch 80*a* or 80*b*, and the tractor and boom 12 are moved one step in a second direction opposite to the direction of the prior move. The lance is again caused to traverse the length of the boom by the other limit switch 80*a* or 80*b*, and the tractor and boom are moved a further step in the second direction. This will place the lance on fresh concrete where it can begin the process all over again. Control of movement of the truck 11, along with selective raising, lowering or tilting of the boom 12 and initiating actuation of the lance chain drive motor 70, can be effected from a control console 86 supported forwardly of the truck 11 by a support arm 87.

The upstanding telescoping boom support arms 13 and 14 enable positioning of the boom for operation with 12 foot high ceiling surfaces. The water passing through the hose 60, lance 58, and nozzle 59 is provided by a high pressure water pump that may experience rapid wear during use. Adding a slight amount of oil to the water can help reduce that wear. Thus, adding one-fourth quart of mobile S-122 into the microfilters of the hydraulic pressure system for each 800 gallons of water discharged from the nozzle, or more generally one quart for each 2000 to 6000 gallons of water, can provide a substantial reduction in the wear to the equipment.

Accordingly, what is claimed is:

1. A method of removing concrete from the surface of a concrete ceiling comprising:

(A) holding a first end of an elongated boom at a first predetermined distance from said surface;

(B) holding a second end of said boom at a second predetermined distance from said surface;

(C) moving a lance along a path on said boom between said first and second ends; and (D) directing a stream of water under pressure, while said lance moves along said path, toward said surface through a nozzle attached to said lance.

2. The method of claim 1 wherein said first distance is substantially the same as said second distance.

3. The method of claim 2 further including the steps of adjusting said first distance and adjusting said second distance to obtain optimum concrete removal.

4. The method of claim 3 further including moving said first and second ends of said boom to selected distances between the highest and lowest of said first and second predetermined distances, respectively.

5. The method of claim 1 including first and second holding means for said first and second ends of said boom, and further including moving said first and second holding means and said boom means along said ceiling.

6. The method of claim 5 wherein the adjusting of said first and second distances is accomplished through the use of hydraulic pressure.

7. The method of claim 6 further including the step of maintaining said first and second ends of said boom at substantially constant heights in the event of failure of the hydraulic pressure.

8. The method of claim 5 further including:

(A) moving said lance means in a first substantially straight direction along said path from said first end to said second end of said boom;

(B) moving said boom means a predetermined distance in a second direction substantially perpendicular to said first direction;

(C) moving said lance means in a third direction substantially opposite to said first direction from said second end to said first end of said boom;

(D) moving said boom means in a fourth direction substantially opposite to said second direction by an amount equal substantially to said predetermined distance; and (E) moving said lance means in said first direction.

9. The method of claim 8 further including for adding oil to the water directed under pressure against said ceiling.

* * * * *

UNITED STATES PATENT AND TRADEMARK OFFICE

CERTIFICATE OF CORRECTION

PATENT NO. : 5,022,927

DATED : June 11, 1991

INVENTOR(S) : Jurgen F. Seidel

It is certified that error appears in the above-identified patent and that said Letters Patent is hereby corrected as shown below:

Column 2, line 19, "a" should be "an".

Column 3, line 19, insert a comma (,) after "16".

Column 3, line 27, "23b" should be "24b".

Column 3, line 37, "23b" should be "24b".

Signed and Sealed this

Twenty-third Day of February, 1993

*Attest:*

STEPHEN G. KUNIN

*Attesting Officer*

*Acting Commissioner of Patents and Trademarks*